United States Patent [19]

Watt

[11] Patent Number: 4,568,132

[45] Date of Patent: Feb. 4, 1986

[54] MOTORIZED LIFT MECHANISM

[75] Inventor: Richard L. Watt, Jamestown, N.Y.

[73] Assignee: Weber-Knapp Company, Jamestown, N.Y.

[21] Appl. No.: 683,694

[22] Filed: Dec. 19, 1984

[51] Int. Cl.[4] ..... A47B 51/00

[52] U.S. Cl. ..... 312/312; 49/26; 312/271; 312/272

[58] Field of Search ..... 312/22, 23, 271, 272, 312/312; 49/26

[56] References Cited

U.S. PATENT DOCUMENTS

| | | | |
|---|---|---|---|
| 639,328 | 12/1899 | Wilson . | |
| 1,101,598 | 6/1914 | Weinke . | |
| 1,228,162 | 5/1917 | Anderson . | |
| 1,986,620 | 1/1935 | Borden et al. | 187/24 |
| 2,514,563 | 7/1950 | Todd | 187/9 |
| 2,527,897 | 10/1950 | Todd | 187/25 |
| 2,737,709 | 3/1956 | Lovelace | 29/290 |
| 2,742,257 | 4/1956 | Hott et al. | 254/7 |
| 2,937,718 | 5/1960 | Larson et al. | 187/24 |
| 3,215,227 | 11/1965 | MacChesney | 187/24 |
| 3,215,402 | 11/1965 | Hott et al. | 254/7 |
| 3,419,320 | 12/1968 | Bedrosen | 49/26 X |
| 3,431,040 | 3/1969 | Phelps et al. | 312/272 |
| 3,468,401 | 9/1969 | Letz | 187/25 |
| 3,620,565 | 11/1971 | Eggert, Jr. et al. | 296/28 A |
| 3,643,919 | 2/1972 | Sothen et al. | 254/98 |
| 3,661,228 | 5/1972 | Glasser | 187/25 |
| 3,761,152 | 9/1973 | Cory | 312/312 |
| 3,794,400 | 2/1974 | Guth | 312/272 X |
| 3,932,009 | 1/1976 | Zollinger | 312/312 |
| 3,993,008 | 11/1976 | Parsons, Sr. | 112/217.1 |

FOREIGN PATENT DOCUMENTS

| | | | |
|---|---|---|---|
| 498884 | 9/1954 | Italy | 312/21 |

*Primary Examiner*—James T. McCall

*Attorney, Agent, or Firm*—Bean, Kauffman & Bean

[57] ABSTRACT

A lift mechanism provides for movement of a platform, or the like, vertically within a cabinet between use and storage positions and is characterized as featuring a compact supporting and guide structure, wherein electrical controls defining the extent of vertical movement of the platform are carried for movement therewith. A safety mechanism is provided to interconnect cabinet lid lifting/lowering stay arms to the platform in a manner serving to prevent pinching of the fingers of a user by the lid, as the latter is moved into a cabinet closed position incident to movement of the platform into its storage position.

9 Claims, 7 Drawing Figures

Fig. 2.
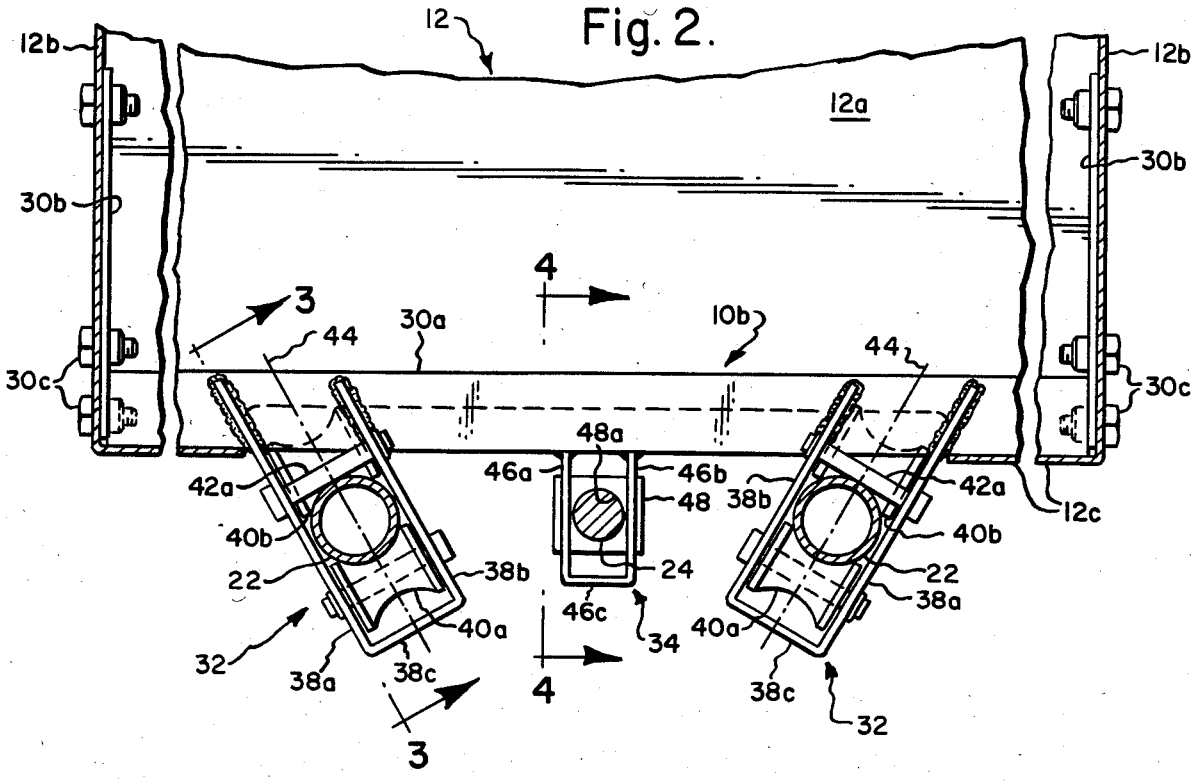
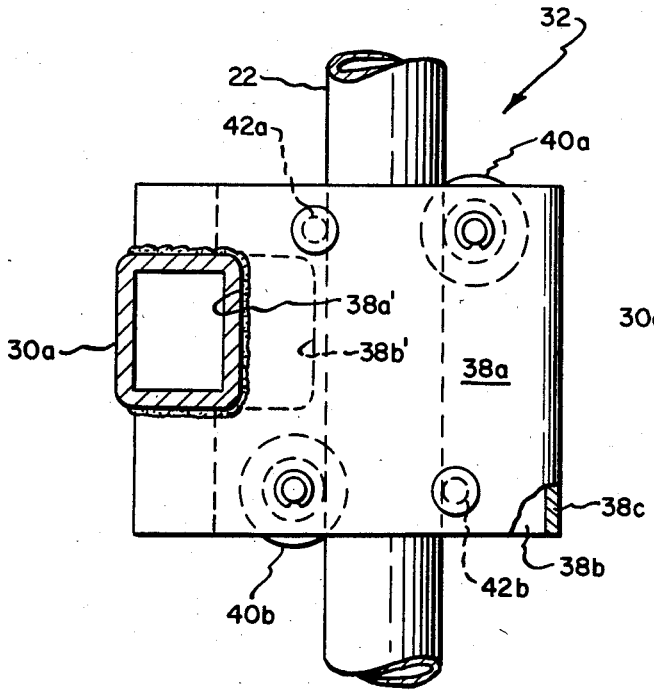
Fig. 3.
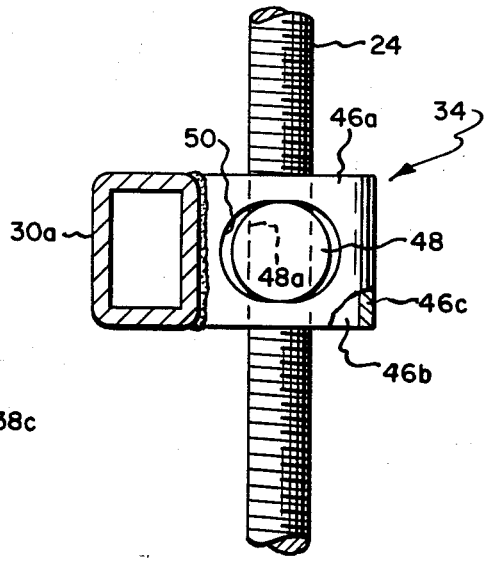
Fig. 4.

Fig. 5.
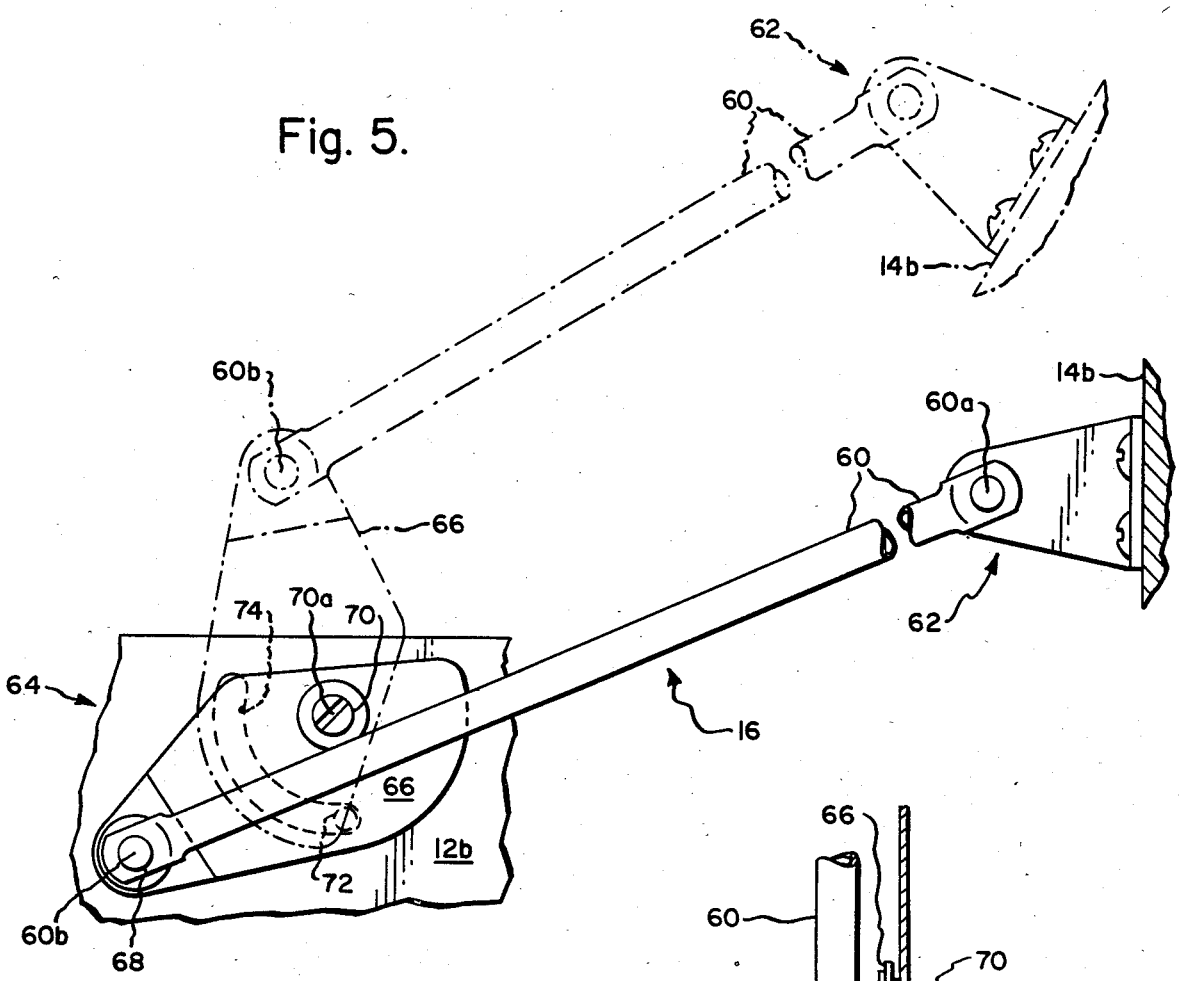
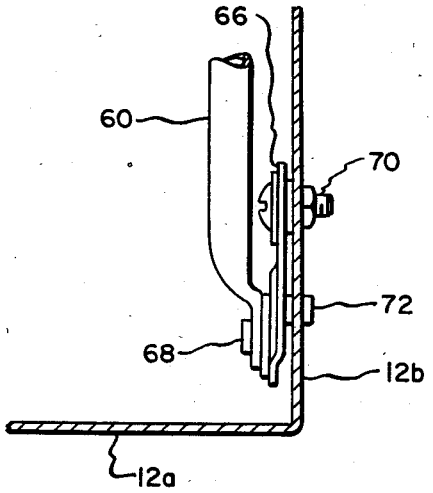
Fig. 7.
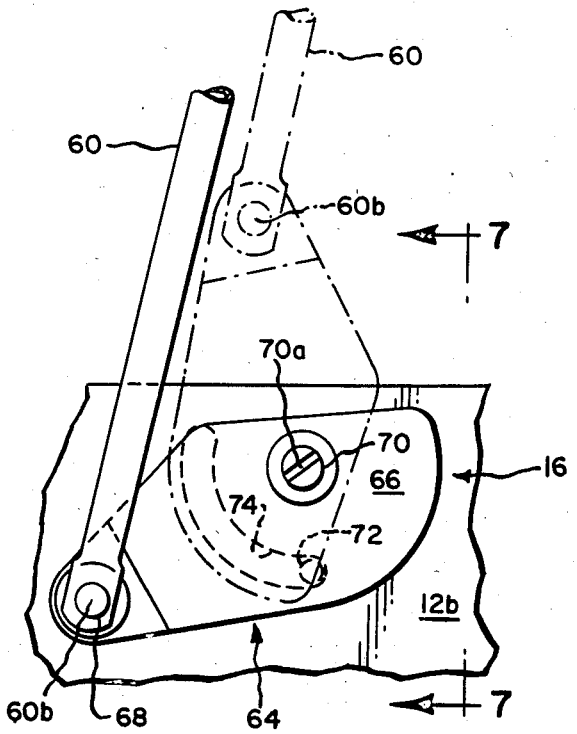
Fig. 6.

MOTORIZED LIFT MECHANISM

BACKGROUND OF THE INVENTION

Heretofore, it has been proposed to provide electric motor driven lift mechanisms adapted for use in moving a platform or the like vertically between at least two spaced positions. Certain of such mechanisms include followers adapted to travel lengthwise of a pair of parallel upstanding guide shafts; a nut coupled to an upstanding, threaded drive shaft adapted to be driven for rotation in opposite directions by an electric motor; and trip or operating fingers arranged to trip or operate stationary limit switches, which alternately serve to de-energize the electric motor upon placement of the platform in its vertically spaced positions. Patents disclosing lift mechanisms of this general type include, for example, U.S. Pats. Nos. 1,986,620; 2,895,567; 3,215,402 and 3,993,008.

SUMMARY OF THE INVENTION

The present invention is directed towards a lift mechanism adapted for effecting vertical movement of a platform or the like within a cabinet between an upper or use position and a lower or storage position, and more particularly to an improved compact mechanism, wherein electrical controls defining the extent of vertical movement of the platform are arranged for movement therewith.

The present invention additionally features the provision of an improved mechanism for interconnecting the platform to a lid of the cabinet in a manner serving to prevent pinching of the fingers of a user between the lid and the front of the cabinet, as the lid is moved into a cabinet closed position incident to movement of the platform into its storage position.

It is also known, as shown for instance in commonly assigned U.S. Pat. No. 3,431,040, to interconnect the lid of a cabinet to a platform movable vertically within the cabinet in a manner providing for automatic opening and closing movements of the lid incident to movements of the platform vertically within the cabinet between an upper use and a lower storage position. Certain of these devices include motion transmitting stay arms coupled to the platform in a manner permitting the stay arms to break away or become uncoupled relative to the platform, as the lid approaches its cabinet closed position, in order to avoid or minimize pinching of the fingers of a user inadvertently placed between the upper rim of the cabinet and the lid.

DRAWINGS

The nature and mode of operation of the present invention will now be more fully described in the following detailed description taken with the accompanying drawings wherein:

FIG. 2 is a sectional view taken generally along the line 2—2 in FIG. 1;

FIG. 3 is a sectional view taken generally along the line 3—3 in FIG. 2;

FIG. 4 is a sectional view taken generally along the line 4—4 in FIG. 2;

FIG. 5 is a view taken generally along the line 5—5 in FIG. 1 and showing alternate positions, which may be assumed by cabinet lid supporting stay arms in an upper position of the platform;

FIG. 6 is similar to FIG. 5, but showing alternate positions, which may be assumed by the stay arms in a lower position of the platform; and FIG. 7 is a sectional view taken generally along the line 7—7 in FIG. 6.

DETAILED DESCRIPTION

Figure 1:
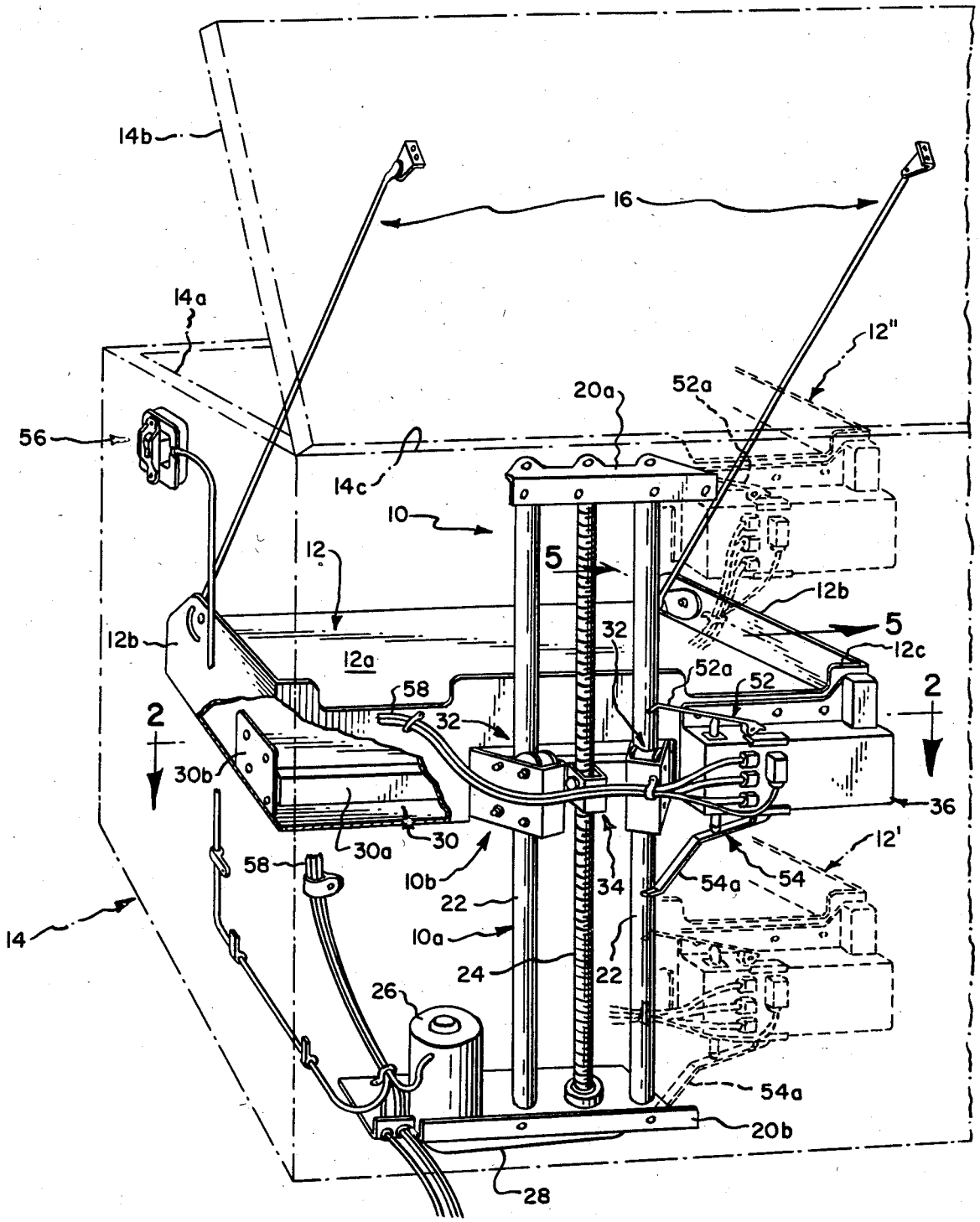
FIG. 1 is a rear perspective view of a platform lift mechanism formed in accordance with the present invention arranged within a cabinet of conventional construction.

Reference is first made to FIG. 1, wherein a lift mechanism formed in accordance with the present invention is generally designated as 10 and shown as being employed to support means, such as a horizontally disposed platform 12, for vertically directed movement within the confines of a cabinet 14.

Platform 12 is shown for example as including a base portion **12*a* from which upstands a pair of opposite side portions 12*b* and a rear portion 12*c*. Cabinet 14 is shown for example as being in the form of a casing or box having an open top serving to define an access opening 14*a*, which may be selectively closed by a lid 14*b* supported by cabinet casing rear wall mounted hinge means, not shown, for vertically directed swinging movements about a hinge axis generally designated as 14*c*** between a generally horizontally disposed access opening closed position and a generally vertically upstanding access opening open position.

In the illustrated arrangement, improved stay means 16 are employed to interconnect lid **14*b* to platform 12 in order to effect swinging movements of the lid between its closed and open positions incident to movement of the platform between the lower or use and upper or storage positions thereof, wherein it is disposed remotely of and adjacent access opening 14*a*, as shown in broken line at 12' and 12'' in FIG. 1. Also, in the illustrated arrangement, platform 12 is sized and adapted to support a CRT unit and associated keyboard for movement within cabinet 14 between use and and storage positions and in this case lid 14*b* serves to conceal the CRT unit and keyboard when in storage position. However, it will be understood that platform 12 may be employed to support diverse items, such as for instance a T.V. set, a sewing machine, etc., and in such cases, if desired, lid 14*b*** may be omitted or may be defined or carried by the upper surface of the item being supported.

Lift mechanism 10 may be considered as having a first portion **10*a*, intended to be non-movably fixed to cabinet 14 and a second portion 10*b* intended to carry platform 12 and be mounted on and for vertical movement relative to first portion 10*a*. First portion 10*a* generally includes vertically aligned, upper and lower generally L-shaped mounting brackets 20*a* and 20*b*, which are intended to be rigidly fixed to the inner surface of the rear wall of cabinet 14, as by screw fasteners, not shown; a pair of parallel upstanding tubular guide shafts 22, which have their upper and lower ends rigidly fixed to facing surfaces of mounting brackets 20*a* and 20*b*, respectively; an upstanding screw threaded drive shaft 24, which is disposed parallel to and equidistant from guide shafts 22 and has its upper and lower ends suitably supported for rotation by mounting brackets 20*a* and 20*b*, respectively; and a reversible drive means, such as may be defined by electric motor 26 mounted on lower mounting bracket 20*b* and a belt-pulley drive arrangement, not shown, which is enclosed within a protective housing or guard 28 and serves to connect the output of motor 26 to the lower end of drive shaft 24**.

Second portion 10*b* generally includes a platform support or mounting means 30, a pair of guide follower means 32 associated one with each of guide shafts 22, a motion transmitting means 34 adapted for cooperation with drive shaft 24 and an electrical control means 36. Preferably, support means 30 is in the form of a horizontally disposed, generally square, tubular bar 30*a* provided with a pair of weld affixed end plates 30*b* to which platform 12 may be affixed via its opposite side portions 12*b* and threaded retainers 30*c*.

Guide follower means 32 are best shown in FIGS. 2 and 3 as being of like construction in that they each include a U-shaped bracket having leg flange portions 38*a* and 38*b* and a connecting flange portion 38*c*; upper and lower groove surfaced guide follower rollers 40*a* and 40*b*; and upper and lower cylindrically surfaced constraint rollers 42*a* and 42*b*. Leg flange portions 38*a* and 38*b* are best shown in FIG. 3 as having generally rectangular mounting slots 38*a'* and 38*b'*, which are arranged to open through the free forwardly disposed ends thereof and sized to receive support bar 30*a* to which such leg flange portions are weld affixed; and a plurality of pairs of aligned mounting apertures for use in mounting rollers 40*a*, 40*b*, 42*a* and 42*b* intermediate support bar 30*a* and connecting flange portion 38*c* with their rotational axis disposed parallel to one another and normal to the leg flange portions. By again viewing FIGS. 2 and 3, it will be understood that upper and lower follower rollers 40*a* and 40*b* are arranged to engage oppositely facing surfaces of an associated one of guide shafts 22 and disposed relatively adjacent connecting flange portion 38*c* and support bar 30*a*, respectively, whereas upper and lower constraint rollers 42*a* and 42*b* are arranged adjacent such oppositely facing surfaces and disposed relatively adjacent the support bar and the connecting flange portion, respectively. Preferably, the constraint rollers are arranged in a relatively closely spaced, but non-contacting relationship with their associated guide shaft 22 and serve solely for the purpose of preventing rearwardly and upwardly directed tilting movements of platform 12; it being intended that follower rollers 40*a* and 40*b* perform the primary guide function and constrain downwardly and forwardly directed tilting movements of the platform under its weight and the weight of items supported thereon.

By again making reference to FIG. 3, it will be noted that leg flange portions 38*a* and 38*b* of each of the follower means 32 are of unequal depth, whereby a pair of vertically disposed planes 44, which are shown only in FIG. 2 as being arranged one coplanar with an axis of each of guide shafts 22 and normal to the rotational axes of the follower and constraint rollers of each of the guide follower means converge in a direction extending rearwardly of support bar 30*a*. This arrangement is preferred from the standpoint that only four guide follower rollers are required to provide for complete stabilization of platform 12 in directions fore and aft of support bar 30*a*, as well as in opposite directions lengthwise thereof.

Motion transmitting means 34 is best shown in FIGS. 2 and 4 as being in the form of a nut coupling means including a U-shaped bracket defined by a pair of leg portions 46*a* and 46*b* and a connecting portion 46*c*; and a nut 48 having a cylindrically shaped body provided with a threaded opening 48*a* extending transversely through a mid-portion thereof and sized to threadably receive drive shaft 24. Leg portions 46*a* and 46*b* have their free forwardly extending ends thereof affixed, as by welding, to support bar 30*a* and are provided with a pair of aligned bearing openings 50 sized to slidably receive opposite ends of nut 48. It will be noted that bearing openings 50 have an oval configuration wherein the major axes thereof extend rearwardly from support bar 30*a* towards connecting portion 46*c*. With this arrangement, nut 48 may undergo slight fore and aft directed rocking movements as required to compensate for nonuniform flexures of guide shafts 22 and drive shaft 24, which may be encountered during raising and lowering of platform 12 and/or to accommodate for slight inaccuracies in the positioning of the axes of the guide and drive shafts one to another.

Electrical control means 36 is shown as having a protective housing 36*a*, which in the illustrated construction is connected to platform rear portion 12*c*, but may be directly supported on support bar 30*a*, if desired. Housing 36*a* serves to mount upper and lower limit switches 52 and 54, which include finger-like operators 52*a* and 54*a* arranged for engagement with upper and lower mounting brackets 20*a* and 20*b* incident to placement of the platform in its upper and lower positions, as shown generally in FIG. 1. A suitable manually operated switch means 56 may be conveniently mounted on cabinet 14 and employed to selectively cause motor 26 to become energized for purposes of driving platform 12 between its upper and lower positions at which limit switches 52 and 54 serve to de-energize the motor. The circuitry within housing 36*a* is connected to motor 26, switch means 56 and to a source of electrical power, not shown, by a bundle of conductors 58 having a length between attachment points sufficient to accommodate for relative vertical movement between housing 36*a* and cabinet 14. The specific circuitry for controlling operation of motor 26 forms no part of the present invention, but may for instance be similar to that described in U.S. Pat. No. 3,993,008.

Stay means 16 preferably includes a pair of like stay arm devices, which are best shown in FIGS. 5, 6 and 7 as each including a rigid, elongated stay arm or rod 60; a first connecting means 62 for connecting one end of rod 60 to lid 14*b* for pivotal movement about a first axis 60*a* arranged parallel to lid hinge axis 14*c*; and a second connecting means 64 for connecting an opposite end of rod 60 to platform 12 for pivotal movement about a second axis 60*b*, which is arranged parallel to first axis 60*a* and adapted for movement along an arcuate path of travel relative to platform 12 between normal and release positions as shown in full and broken line in FIGS. 5 and 6, respectively. More specifically, second connecting means 64 includes a link 66; means, such as a pivot pin 68, for connecting rod 60 to link 66 for pivotal movement about axis 60*b*; means, such as a pivot pin 70, for pivotally supporting an opposite end of link 66 on platform 12 for pivotal movement about an axis 70*a* disposed parallel to axis 60*b*; and means for coupling link 66 to platform 12 in the manner serving to define normal and release positions of the link. Preferably, the coupling means is defined by a pin 72, which projects from link 66 for receipt within an arcuate slot 74, which is defined by platform side portion 12*b* and arranged concentric of the axis 70*a*.

Now referring to FIG. 5, it will be understood that stay means 16 occupies its illustrated full line position, when platform 12 is in its uppermost or use position and lid 14*b* assumes its normal, fully opened position. It will be noted that the normal arrangement of axes 60*a* and 60*b* relative to the axis of pivot pin 70 when platform 12 is in its use position, is such that lid 14*b* is prevented from undergoing uncontrolled forwardly directed swinging or closing movements by the ability of rod 60 to resist compression or bending under expected operating conditions. On the other hand, engagement of pin 72 with the lower or first end of slot 74 normally serves to prevent rearwardly directed pivotal movement of lid 14*b* beyond its normal open position. However, controlled pivotal movement of lid 14*b* into a position disposed rearwardly of its normal open position for purposes of facilitating greater access to the contents of cabinet 10 may be effected by manually lifting or swinging link 66 into its upper or release position shown in broken line in FIG. 5, which is defined by engagement of pin 72 with an opposite or upper end of slot 74.

By again viewing FIGS. 5 and 6, it will be understood that during normal opening and closing movements of lid 14*b*, the weight of the lid tends to maintain second axis 60*b* in its normal position determined by engagement of pin 72 with the first or lower end of slot 74, as shown in full line in these figures. It will also be noted by referring to FIG. 6 that when platform 12 is disposed in its illustrated storage position, lid 14*b* may be lifted into a partially open position intermediate the closed and normal open positions thereof through some desired angle as for instance at 20°, incident to which second axis 60*b* is free to move along an arcuate path about a center defined by pivot pin 70 until it assumes a release position, which is shown in broken line in FIG. 6 and determined by engagement of pin 72 with the opposite or upper end of slot 74. The purpose of this arrangement is to prevent pinching of the fingers or a user between the lid and the upper rim of the cabinet, as platform 12 descends into its storage position. Thus, when lid 14*b* engages the fingers of a user inadvertently resting on the upper rim of the cabinet, motion of the lid is arrested, as platform 12 continues to descend into its storage position, under the control of motor 26, and the only force to which the fingers are exposed would be due to the weight of the lid, which would normally be insufficient to cause serious injury. Of course, as the fingers of the user are moved rearwardly along the rim of the cabinet towards the lid hinge axis 14*c*, the likelihood of a user's fingers becoming pinched increases and, thus, if in a given cabinet installation, the rim of the cabinet immediately adjacent the hinge area of the lid is accessible to a user, additional means, not shown, would preferably be provided to prevent insertion of the fingers of the user between the rim of the cabinet and lid. Such additional means may for example take the form of finger protection plates of the type disclosed in commonly assigned co-pending patent application Ser. No. 610,341, filed May 15, 1984.

What is claimed is:

1. A cabinet having in combination:

a vertically upwardly opening access opening;

a lid pivotally mounted on the cabinet for movement between access opening closed and open positions;

platform means;

a lift mechanism for moving said platform means vertically within said cabinet between lower and upper positions disposed remotely of and adjacent said access opening, said lift mechanism includes upper and lower lift mechanism mounting brackets, a pair of vertically upstanding and parallel guide shafts having upper and lower ends thereof fixed to said upper and lower mounting brackets, a screw threaded drive shaft having upper and lower ends thereof rotatably supported by said upper and lower mounting brackets and arranged parallel to and intermediate said guide shafts, a reversible drive means for rotating said drive shaft in opposite directions, means for controlling operation of said drive means, a horizontally extending support bar for supporting said platform means to project forwardly thereof, a pair of guide follower means carried by said support bar to project rearwardly thereof for engagement one with each of said guide shafts for constraining said support bar to reside in a horizontally disposed position and for movement lengthwise of said guide shafts to alternately position said platform means in said lower and upper positions, nut coupling means carried by said support bar to project rearwardly thereof for threadable engagement with said drive shaft to impart oppositely directed movements to said support bar lengthwise of said guide shafts incident to oppositely directed rotational movements of said drive shaft; and stay means for interconnecting said lid and said platform means to normally effect pivotal movements of said lid back and forth between its closed and open positions incident to movement of said platform means back and forth between said lower and upper positions, respectively, said stay means including at least one rigid, elongated rod, first connecting means for connecting one end of said rod to said lid for pivotal movement about a first axis, and second connecting means for connecting an opposite end of said rod to said platform means for pivotal movement about a second axis arranged parallel to said first axis and adapted for movement along an arcuate path of travel relative to said platform means between normal and release positions, characterized in that the weight of said lid tends to retain said second axis in said normal position whereupon said lid tends to assume said closed position incident to placement of said platform means in said lower position and in that movement of said second axis between said normal and release positions permits said lid to remain in a partially open position intermediate said open and closed positions incident to placement of said platform means in said lower position.

2. The cabinet according to claim 1, wherein said support bar is of generally rectangular cross-sectional configuration, each of said guide follower means includes a U-shaped bracket having leg flange portions and a connecting flange portion, upper and lower groove surfaced guide follower rollers and upper and lower cylindrical surfaced constraint rollers, said leg flange portions having generally rectangular mounting slots opening through free, forwardly disposed ends thereof and sized to receive said support bar and a plurality of pairs of aligned mounting apertures for mounting said follower and constraint rollers intermediate said support bar and said connecting flange portion and with their rotational axes disposed parallel to one another and normal to said leg flange portions, said upper and lower follower rollers engaging oppositely facing surfaces of an associated one of said guide shafts and disposed relatively adjacent said connecting flange portion and said support bar, respectively, said upper and lower constraint rollers arranged in an adjacent non-contacting relationship to said oppositely facing surfaces and disposed relatively adjacent said support bar and said connecting flange portion, respectively, and said leg flange portions of each of said guide follower means are of unequal lengths, whereby a pair of vertically disposed planes arranged one coplanar with an axis of each of said guide shafts and normal to the rotational axes of said follower and constraint rollers of each of said guide follower means converge in a direction extending rearwardly of said support bar; and said second connecting means includes a link, means for connecting said opposite end of said rod to one end of said link for pivotal movement about said second axis, means for connecting an opposite end of said link to said platform means to permit movement of said second axis along said path of travel and means coupling said link to said platform means to define said normal and release positions.

3. In a cabinet having a vertically upwardly opening access opening; a lid pivotally mounted on the cabinet for movement between access opening closed and open positions; platform means; a lift mechanism for moving said platform means vertically within said cabinet between lower and upper positions disposed remotely of and adjacent said access opening; and stay means interconnecting said lid and said platform means to normally effect pivotal movements of said lid back and forth between its closed and open positions incident to movement of said platform means back and forth between said lower and upper positions, respectively, the improvement wherein said stay means includes at least one rigid, elongated rod; first connecting means for connecting one end of said rod to said lid for pivotal movement about a first axis; and second connecting means for connecting an opposite end of said rod to said platform means for pivotal movement about a second axis arranged parallel to said first axis and adapted for movement along an arcuate path of travel relative to said platform means between normal and release positions, characterized in that the weight of said lid tends to retain said second axis in said normal position whereupon said lid tends to assume said closed position incident to placement of said platform means in said lower position, and in that movement of said second axis between said normal and release positions permits said lid to remain in a partially open position intermediate said open and closed positions incident to placement of said platform means in said lower position.

4. The improvement according to claim 3, wherein said second connecting means includes a link, means for connecting said opposite end of said rod to one end of said link for pivotal movement about said second axis, means for connecting an opposite end of said link to said platform means to permit movement of said second axis along said path of travel and means coupling said link to said platform means to define said normal and release positions.

5. The improvement according to claim 4, wherein the last said means includes a slot formed in said platform means and pin means carried by said link and received within said slot for movement between opposite ends thereof serving to define said normal and release positions.

6. In a cabinet having a vertically upwardly opening access opening; platform means; and a lift mechanism for moving said platform means vertically with respect to said cabinet between lower and upper positions disposed remotely of and adjacent said access opening, the improvement wherein:

said lift mechanism includes a first portion for mounting said lift mechanism on said cabinet, said first portion including upper and lower lift mechanism mounting brackets, a pair of vertically upstanding and parallel guide shafts having upper and lower ends thereof fixed to said upper and lower mounting brackets, a screw threaded drive shaft having upper and lower ends thereof rotatably supported by said upper and lower mounting brackets and arranged parallel to and intermediate said guide shafts, and reversible drive means for rotating said drive shaft in opposite directions, and a second portion for mounting said platform means on said first portion for vertical movement with respect to said cabinet between said lower and upper positions, said second portion including a horizontally extending support bar for supporting said platform means to project forwardly thereof, a pair of guide follower means carried by said support bar to project rearwardly thereof for engagement one with each of said guide shafts for constraining said support bar to reside in a horizontally disposed position and for movement lengthwise of said guide shafts to alternately position said platform means in said lower and upper positions, nut coupling means carried by said support bar to project rearwardly thereof for threadable engagement with said drive shaft to impart oppositely directed movements to said support bar lengthwise of said guide shafts incident to oppositely directed rotational movements of said drive shaft, and means for controlling operation of said drive means including a pair of limit switches carried for movement with said support bar for engagement one with each of said mounting brackets to define said lower and upper positions of said platform means.

7. In a cabinet having a vertically upwardly opening access opening; platform means; and a lift mechanism for moving said platform means vertically with respect to said cabinet between lower and upper positions disposed remotely of and adjacent said access opening, the improvement wherein said lift mechanism includes:

upper and lower lift mechanism mounting brackets;

a pair of vertically upstanding and parallel guide shafts having upper and lower ends thereof fixed to said upper and lower mounting brackets;

a screw threaded drive shaft having upper and lower ends thereof rotatably supported by said upper and lower mounting brackets and arranged parallel to and intermediate said guide shafts;

reversible drive means for rotating said drive shaft in opposite directions;

means for controlling operation of said drive means;

a horizontally extending support bar for supporting said platform means to project forwardly thereof;

a pair of guide follower means carried by said support bar to project rearwardly thereof for engagement one with each of said guide shafts for constraining said support bar to reside in a horizontally disposed position and for movement lengthwise of said guide shafts to alternately position said platform means in said lower and upper positions, each of said guide follower means includes a U-shaped bracket having leg flange portions and a connecting flange portion, upper and lower groove surfaced guide follower rollers and upper and lower cylindrically surfaced constraint rollers, said leg flange portions having generally rectangular mounting slots opening through free, forwardly disposed ends thereof and sized to receive said support bar and a plurality of pairs of aligned mounting apertures for mounting said follower and constraint rolers intermediate said support bar and said connecting flange portion and with their rotational axes disposed parallel to one another and normal to said leg flange portions, said upper and lower follower rollers engaging oppositely facing surfaces of an associated one of said guide shafts and disposed relatively adjacent said connecting flange portion and said support bar, respectively, said upper and lower constraint rollers arranged in an adjacent noncontacting relationship to said oppositely facing surfaces and disposed relatively adjacent said support bar and said connecting flange portion, respectively, and said leg flange portions of each of said guide follower means are of unequal lengths, whereby a pair of vertically disposed planes arranged on coplanar with an axis of each of said guide shafts and normal to the rotational axes of said follower and constraint rollers of each of said guide follower means converge in a direction extending rearwardly of said support bar; and nut coupling means carried by said support bar to project rearwardly thereof for threadable engagement with said drive shaft to impart oppositely directed movements to said support bar lengthwise of said guide shafts incident to oppositely directed rotational movement of said drive shaft.

8. The improvement according to claim 7, wherein said nut coupling means includes a U-shaped bracket defined by a pair of leg portions and a connecting portion, and a nut having a cylindrically shaped body provided with a threaded opening extending transversely through a mid-portion thereof and sized to threadably receive said drive shaft, said leg portions having free forwardly disposed ends fixed to said support bar and a pair of aligned bearing openings sized to slidably receive opposite ends of said body, and said bearing openings have oval configurations, wherein a major axis thereof extends rearwardly of said support bar towards said connecting portion.

9. The improvement according to claim 8, wherein said drive means is controlled by means including a pair of limit switches carried for movement with said support bar for engagement one with each of said mounting brackets to define said lower and upper positions of said platform means.

* * * * *

UNITED STATES PATENT AND TRADEMARK OFFICE

CERTIFICATE OF CORRECTION

PATENT NO. : 4,568,132

DATED : February 4, 1986

INVENTOR(S) : Richard L. Watt

It is certified that error appears in the above-identified patent and that said Letters Patent are hereby corrected as shown below:

Col. 2, line 39 - the second occurrence of "and" should be deleted.

Col. 5, line 35 - "or" should be --of--.

Col. 9, line 7 - "rolers" should be --rollers--.

Col. 9, line 24 - "on" should be --one--.

Signed and Sealed this

*Twenty-second* Day of *July 1986*

[SEAL]

*Attest:*

DONALD J. QUIGG

*Attesting Officer*

*Commissioner of Patents and Trademarks*